US005622674A

United States Patent [19]

Bourrat

[11] Patent Number: 5,622,674

[45] Date of Patent: Apr. 22, 1997

[54] TOOL STEEL COMPOSITIONS AND METHOD OF MAKING

[75] Inventor: Jean Bourrat, St. Georges De Mons, France

[73] Assignee: Aubert et Duval SA, France

[21] Appl. No.: 411,836

[22] PCT Filed: Oct. 5, 1993

[86] PCT No.: PCT/FR93/00979

§ 371 Date: Apr. 3, 1995

§ 102(e) Date: Apr. 3, 1995

[87] PCT Pub. No.: WO94/09170

PCT Pub. Date: Apr. 28, 1994

[30] Foreign Application Priority Data

Oct. 9, 1992 [FR] France ..... 92 12007

[51] Int. Cl.[6] ..... C22C 38/12; C21D 6/00

[52] U.S. Cl. ..... 420/109; 420/111; 148/334; 148/335; 148/547

[58] Field of Search ..... 420/109, 111; 148/547, 334, 335

[56] References Cited

U.S. PATENT DOCUMENTS

| | | | |
|---|---|---|---|
| 3,272,622 | 9/1966 | Bengtsson . | |
| 5,011,656 | 4/1991 | Ohori et al. | 420/109 |
| 5,437,742 | 8/1995 | Siga et al. | 148/335 |

FOREIGN PATENT DOCUMENTS

| | | | |
|---|---|---|---|
| 1174491 | 8/1985 | U.S.S.R. | 148/334 |

*Primary Examiner*—Deborah Yee
*Attorney, Agent, or Firm*—Dvorak and Traub

[57] ABSTRACT

A tool steel composition including, expressed by weight: 2.5% to 5.8% Cr, not more than 1.3% V, not more than 0.8% Si, with an Mo content lying in the range 0.75% to 1.75%, and not more than 0.35% Si, when the Mo content is 2.5% to 3.5%, with 0.3% to 0.4% by weight of C. Also disclosed is a method of preparing and of shaping such steels, as well as parts obtained thereby.

6 Claims, No Drawings

TOOL STEEL COMPOSITIONS AND METHOD OF MAKING

The present invention relates to a family of steels known as 3%–5% chromium steels (% by weight) and that are used for manufacturing tooling that withstands heat under high stresses, such as dies for stamping and forging, and dies for casting under pressure or for static casting of various alloys such as alloys of aluminum or of titanium.

In general, such steels contain 3% to 5% by weight of chromium, even though contents in the range 2% to 6% are to be observed. More precisely, they comprise essentially three families of compositions which, although slightly different from one another, all confer physical properties that are similar such that these steel compositions are used for the same applications. These families are compositions that comprise, expressed by weight:

5% Cr, 1.3% Mo, and 0.5% to 1.3% V; or

3% Cr, 3% Mo, 0.5% V; or

5% Cr, 3% Mo, 0.8% V.

Over the last few decades, the use of such steels has become widespread in workshops for making forged or stamped parts on presses and on stampers, and also in light alloy foundries, e.g. for making dies for parts that are cast in steels or light alloys for the automotive industry, such as sumps, clutch casings, or gear box casings.

Some of these steels are designated by the names H 11, H 12, and H 13 in the AISI nomenclature of the United States of America, or by the names W-1.2343, W-1.2606, and W-1.2344 in the DIN nomenclature. French standard NFA 35590 likewise defines analogous compositions.

Silicon is a hardening element, and a content of about 1% by weight confers high strength of about 1800 MPa or more to mechanical parts. This strength is not required in the intended forging uses, except for parts that are very flat, and is never required in pressure dies for aluminum, where a Rockwell C hardness (HRC) no greater than 48 suffices.

It is known, in particular for 3%–5% chromium steels, that successful annealing heat treatment is a necessary prerequisite for successful quality heat treatment. Thus, the fineness and the homogeneity of the microstructure in the finished product after treatment for final use are derived from those observed after annealing. That is why professionals commonly use a chart of microphotographs of structures in the annealed state showing microstructures that are within specification and microstructures that are not.

This practice, which is widespread at present, has progressively "frozen" conditions of manufacture, of thermomechanical transformation, and of annealing. In addition, it has been observed that the fining of the annealed structure is conditioned by the homogeneity of the structure in the austenite range, which makes it necessary to avoid the presence of primary carbides, and by the coherent dispersion of the precipitates of secondary carbides $M_{23}C_6$ (M=Cr, Fe, Mo, . . . ) during subsequent heat treatments.

The Applicant has also been able to show that certain zones that appear to be rougher, and that sometimes appear in the form of needles of Bainite-like appearance, particularly in pieces of large section, have higher concentrations of silicon.

On the basis of these fundamental considerations, steels have been developed that have acceptable homogeneous annealed structures.

To this end, the invention provides two types of tool steel composition.

The first type of tool steel composition of the invention comprises, expressed by weight:

4.5% to 5.8% Cr;

0.75% to 1.75% Mo;

not more than 1.3%, and preferably 0.25% to 0.50% V;

not more than 0.8%, and preferably not more than 0.35% Si;

0.3% to 0.4% C; and in addition, where appropriate not more than 0.8% Mn and/or not more than 1.5% W;

the balance being constituted by Fe, and usual additives and impurities;

with Ni constituting a possible impurity being at no more than 0.5%.

The second type of tool steel composition of the invention comprises, expressed by weight:

2.5% to 5.5% Cr;

2.5% to 3.5% Mo;

not more than 1.3% V;

not more than 0.35% Si;

0.3% to 0.4% C; and also, where appropriate not more than 5% Co;

the balance being constituted by Fe and usual ordinary additives and impurities.

Such compositions give rise to homogenization of the annealed structure, which becomes more difficult to achieve with increasing section of the parts, by eliminating the formation of silicon-enriched ferritic zones and also the formation of primary carbides which are always difficult to put into solution.

In addition, these two modifications do not give rise to significant changes to the range of heat treatments in fields of utilization: the differences that may be observed for the values of strength and elastic limit can easily be compensated by adjusting the temperature of the second annealing, which is within the competence of any person skilled in the art.

Furthermore, reducing the silicon content has no or little influence on the resistance of the steel to oxidation up to its maximum temperatures of utilization, i.e. in the forging range (600° C. to 650° C.). However, the uniformity of macrostructure (striped structure less marked) and of microstructure guarantee good strength in service, i.e. good characteristics relating to toughness, mechanical fatigue, and thermal fatigue.

In a preferred embodiment, the compositions of the invention include C in the weight range 0.32% to 0.38% and especially in the more particularly preferred range 0.34% to 0.36%.

In addition, the proportions of phosphorous, antimony, tin, and arsenic expressed in percentages by weight, advantageously satisfy the following relationships:

$P \leqq 0.008\%$;

$Sb \leqq 0.002\%$;

$Sn \leqq 0.003\%$;

$As \leqq 0.005\%$;

with the value expressed by the Bruscato relationship $B=(10\ P+5\ Sb+4\ Sn+As)\times 10^{-2}$ being no greater than 0.10%.

A second main aspect of the present invention consists in a method of preparation and of shaping steel having a composition in accordance with the above description, which method includes remelting by means of a consumable electrode under a vacuum or by means of a consumable electrode under slag, or by both means in combination, the shaping preferably being performed by thermomechanical transformation such as forging or rolling, or by molding. The method of the invention also advantageously includes:

complete solution heat treatment at temperatures lying in the range 950° C. to 1100° C., and preferably in the range 980° C. to 1010° C., followed by quenching in air or in a fluid down to ambient temperature, or staged quenching in the range 250° C. to 450° C., and preferably in the range 250° C. to 280° C.; and then a series of at least two annealings to adjust the intended hardness.

Quenching is advantageously performed in the range 250° C. to 280° C., i.e. below the Martensite start point ($M_s$) in a fluid, e.g. a nitrate bath.

At least two annealings are recommended, the first at the secondary hardening peak (550° C. to 560° C.), the second in the overaging range, i.e. at a temperature greater than or equal to 570° C. It is the adjustment of temperature in the second annealing that confers hardness to the treated product.

In a third aspect, the invention provides a steel part having the composition described above, and preferably manufactured in application of a method also described above.

Such parts are particularly appropriate for manufacturing tools or mechanical parts that work at high temperatures and under high levels of stress, and in particular dies for forging, stamping, or casting either under pressure or under gravity, both with steels and with various light alloys such as aluminium alloys or Zamak type alloys or titanium alloys.

The following examples illustrate the present invention.

TABLE 1

| | 3 | 4 |
|---|---|---|
| C | 0.36 | 0.34 |
| Si | 0.33 | 0.33 |
| Mn | 0.35 | 0.35 |
| S | 0.0011 | 0.0010 |
| P | 0.015 | 0.006 |
| Ni | 0.24 | 0.040 |
| Cr | 5.18 | 5.17 |
| Mo | 1.25 | 1.25 |
| N | 0.053 | 0.048 |
| Al | 0.006 | 0.007 |
| Co | <0.07 | <0.020 |
| Sn | 0.0043 | 0.0028 |
| As | 0.077 | 0.004 |
| Sb | 0.009 | 0.0008 |

EXAMPLE 1

For steels 1, 2, 3 and 4, total traction strength R (MPa), elastic limit E (MPa) to 0.2% elongation, elongation A (%), and necking Z (%) were measured at various different temperatures, after annealing twice at 550° C. to 560° C.:

for total traction strength at a level of 1700 MPa to 1800 MPa (Table 2); and for total traction strength at a level of 1300 MPa to 1400 MPa (Table 3).

TABLE 2

| | T | | | | | | | | | | | | | | | | | | | | | | | |
|---|---|---|---|---|---|---|---|---|---|---|---|---|---|---|---|---|---|---|---|---|---|---|---|---|
| | 20° C. | | | | 300° C. | | | | 500° C. | | | | 550° C. | | | | 600° C. | | | | 650° C. | | | |
| steel | R | E | A | Z | R | E | A | Z | R | E | A | Z | R | E | A | Z | R | E | A | Z | R | E | A | Z |
| 1 | 1895 | 1540 | 10,1 | 44 | 1686 | 1333 | 12,4 | 54 | 1419 | 1077 | 14,8 | 61 | 1063 | 797 | 17,4 | | 617 | 385 | 34,5 | 90 | 339 | 182 | 44 | 94 |
| 2 | 1852 | 1542 | 11,5 | 51 | | | | | 1407 | 1034 | 13,2 | 60 | 1060 | 805 | 17,6 | | | | | | 331 | 176 | 58 | 96 |
| 3 | 1752 | 1422 | 13,3 | 61 | 1528 | 1211 | 14,2 | 64 | 1347 | 1006 | 15,7 | 65 | 1067 | 824 | 16,8 | | 611 | 429 | 32 | 89 | 341 | 187 | 56 | 95 |
| 4 | 1698 | 1406 | 14,5 | 63 | 1515 | 1198 | 14,5 | 66 | 1360 | 1084 | 14,2 | 65 | 1076 | 834 | 20,7 | | 642 | 455 | 30 | 85 | 355 | 184 | 56 | 95 |

TABLE 3

| | T | | | | | | | | | | | | | | | | | | | | | | | |
|---|---|---|---|---|---|---|---|---|---|---|---|---|---|---|---|---|---|---|---|---|---|---|---|---|
| | 20° C. | | | | 300° C. | | | | 500° C. | | | | 550° C. | | | | 600° C. | | | | 650° C. | | | |
| steel | R | E | A | Z | R | E | A | Z | R | E | A | Z | R | E | A | Z | R | E | A | Z | R | E | A | Z |
| 1 | 1353 | 1111 | 14,1 | 53 | 1199 | 980 | 12,9 | 60 | 973 | 760 | 14,5 | 72 | 846 | 622 | 19,8 | 78 | 555 | 340 | 31,5 | 87 | 328 | 162 | 36,5 | 96 |
| 2 | 1379 | 1138 | 14,6 | 58 | | | | | | | | | 847 | 635 | 20,9 | 76 | 549 | 355 | 37 | 89 | 333 | 170 | 44 | 95 |
| 3 | 1314 | 1094 | 16,2 | 65 | 1115 | 938 | 14,5 | 67 | 939 | 753 | 16,5 | 74 | 833 | 653 | 18,9 | 79 | 584 | 396 | 25,9 | 87 | 345 | 198 | 37,5 | 94 |
| 4 | 1308 | 1093 | 16,0 | 64 | 1128 | 935 | 14,0 | 68 | 943 | 774 | 15,2 | 73 | 851 | 671 | 22,6 | 81 | 616 | 431 | 26,5 | 88 | 361 | 197 | 37,5 | 96 |

The mechanical properties of two steels 3 and 4 of the invention whose compositions in percentages by weight are given below in Table 1 were compared with those of two steels 1 and 2 representative of the prior art, steel 1 being DIN W-1.2343 steel and steel 2 being steel 1 after being subjected to remelting.

For total traction strength at the 1700 MPa to 1800 MPa level, the characteristics of steels of the invention are a little less good. At the 1300 MPa to 1400 MPa level, the differences have disappeared.

At both levels, the values of the characteristics (rapid traction at temperature) are identical as from 500° C. to 550° C., i.e. in the industrial working range.

It should also be observed that in certain cases, the mechanical characteristics of steels of the invention that are less good are nevertheless still satisfactory for tooling, where better characteristics are rarely required.

EXAMPLE 2

Bending tests were performed on steels 1, 2, 3, and 4, by measuring the breaking energy (in Joules) on non-cracky testpieces (NCT) of the Charpy V type, i.e. on testpieces having a V-notch, for total traction strength R=1300 MPa to 1400 MPa (42±1HRC). The results are given in Table 4 below.

TABLE 4

| Steel\Direction | Length | Width |
|---|---|---|
| 1 | 45 | 29 |
| 2 | 55 | 46 |
| 3 | 77 | 32 |
| 4 | 93 | 59 |

EXAMPLE 3

Breaking energy (in Joules) was measured on the same steels as in the above examples, breaking energy being obtained by extrapolation for a cracking depth tending towards zero, i.e. zero crack energy (ZCE), using testpieces that had been teated to the 42±1 HRC level.

This test is used as a criterion for measuring sensitivity to cracking in the presence of a crack. It can be summed up as follows.

A Charpy V testpiece was pre-cracked at the bottom of its notch and broken after pre-cracking on a 30 Joule Charpy V pendulum.

After breaking, there can be observed on the break the initial depth of the fatigue crack, and the depth of the sudden break. It is also shown that break energy and break area are proportional to each other.

Zero crack energy is determined by extrapolating the straight line measuring total break energy as a function of pre-cracking depth starting from the point (energy zero/crack depth=8 mm) and extending to zero crack depth, i.e. to the y-axis.

Zero crack energy represents tearing energy. It is always less than break energy on a conventional non-cracked testpiece. The difference between them is a measure of the plastic deformation energy located in the bottom of the notch.

Certain testpieces, after treatment to have a hardness of 42 HRC, were not subjected to aging, whereas others were subjected to aging for 50 hours at 550° C. These tests made it possible to determine to what extent the susceptibility to cracking decreases on going from grades 1 and 2 to grade 3 and finally to grade 4. The results of the tests are given in Table 5 below.

TABLE 5

| | Length | | Width | |
|---|---|---|---|---|
| Direction Steel | Not aged | Aged 550°/ 50 hours | Not aged | Aged 550°/ 50 hours |
| 1 | 17.5 | 18 | 15.5 | 17.5 |
| 2 | 29.5 | 20 | 19.5 | 16 |

TABLE 5-continued

| | Length | | Width | |
|---|---|---|---|---|
| Direction Steel | Not aged | Aged 550°/ 50 hours | Not aged | Aged 550°/ 50 hours |
| 3 | 69 | 35 | 23 | 25 |
| 4 | 90 | 60 | 61 | 36 |

In particular, it can be seen that for the testpieces of grades 3 and 4, the values of NCT and of ZCE are very close together (and their ratio is close to 1 for steel 4) which means that the plastic deformation energy localized at the bottom of the notch is small.

After being held at 550° C. for 50 hours, the ZCE/NCT ratio is less favorable, but the values of ZCE, although not so good, are still very high.

I claim:

1. A tool steel composition consisting essentially of, expressed by weight:

4.5% to 5.8% Cr;

0.75% to 1.75% Mo;

0.25% to 0.50% V;

not more than 0.35% Si;

0.34% to 0.36% C;

not more than 0.8% Mn;

not more than 1.5% W;

not more than 0.5% Ni;

the balance being constituted by Fe, and inevitable impurities;

the concentrations in said composition of the impurities P, Sb, Sn, and As, satisfying the following relationships:

$P \leqq 0.008\%$;

$Sb \leqq 0.002\%$;

$Sn \leqq 0.003\%$;

$As \leqq 0.005\%$;

with the value expressed by the Bruscato relationship $B=(10\ P+5\ Sb+4\ Sn+As)\times 10_{-2}$ being no greater than 0.10%.

2. A method of preparing a tool steel having a composition according to claim 1, comprising the steps of:

performing complete solution heat treatment at temperatures lying in the range 950° C. to 1100° C., followed by quenching according to one of (a) quenching in air or in a fluid down to ambient temperature, and (b) staged quenching in the range 250° C. to 450° C.; and then performing a series of at least two annealings to adjust the intended hardness.

3. A method according to claim 2, wherein solution treatment is performed at temperatures lying between the range 980° C. to 1010° C.

4. A method according to claim 2, wherein the staged quenching operation is performed in the range of 250° C. to 280° C.

5. A die for stamping and forging steels and light alloys, the die being constituted by a steel having the composition according to claim 1.

6. A die for casting under pressure or by gravity steels and light alloys, the die being constituted by a steel having the composition according to claim 1.

* * * * *